US005316151A

United States Patent [19]

Thompson

[11] Patent Number: 5,316,151

[45] Date of Patent: May 31, 1994

[54] MAGNETIC PARTICLE SEPARATOR

[75] Inventor: R. Bruce Thompson, Havertown, Pa.

[73] Assignee: The Boeing Company, Seattle, Wash.

[21] Appl. No.: 28,226

[22] Filed: Mar. 9, 1993

[51] Int. Cl.[5] ..... B03C 1/00

[52] U.S. Cl. ..... 209/223.1; 209/228; 335/306

[58] Field of Search ..... 209/215, 223.1, 223.2, 209/228; 210/222, 223; 312/283, 330.1; 335/302, 306

[56] References Cited

U.S. PATENT DOCUMENTS

| | | | |
|---|---|---|---|
| 2,733,812 | 2/1956 | Hoff | 209/223.1 |
| 2,941,659 | 6/1960 | Thrower et al. | 312/283 X |
| 2,992,734 | 7/1961 | Maynard | 209/223.1 |
| 2,992,735 | 7/1961 | Troy | 209/223.1 |
| 3,160,583 | 12/1964 | Stem | 209/223.1 |
| 3,524,549 | 8/1970 | Walter | 210/222 |
| 4,144,012 | 3/1979 | Pinkley | 209/223.1 X |
| 4,620,923 | 11/1986 | Meister | 209/223.1 |
| 4,750,996 | 6/1988 | Meister | 209/223.1 |
| 4,867,869 | 10/1989 | Barrett | 209/223.2 |
| 4,946,589 | 8/1990 | Hayes | 210/222 |
| 5,071,541 | 12/1991 | Thompson | 209/2 |
| 5,188,239 | 2/1993 | Stowe | 209/223.1 |

FOREIGN PATENT DOCUMENTS

| | | | |
|---|---|---|---|
| 3307319 | 9/1984 | Fed. Rep. of Germany | 209/223.2 |

*Primary Examiner*—D. Glenn Dayoan
*Assistant Examiner*—Tuan Nguyen
*Attorney, Agent, or Firm*—Jones, Tullar & Cooper

[57] ABSTRACT

A magnetic particle separator which provides a magnetic grate in which magnetic rods are inserted in non-magnetic tubes forming a magnetic grate in the particle stream to be separated. The Magnetic rods can be removed from the assembly only when the grate is removed from the particle stream. The invention also provides a system of at least two separators assembled in series in the particle stream so that one of the separators may be removed for cleaning and the other will perform the separating function thus not requiring the system to be shut down during separator cleaning.

7 Claims, 3 Drawing Sheets

MAGNETIC PARTICLE SEPARATOR

BACKGROUND OF THE INVENTION

This invention relates in general to magnetic particle separators and, in particular to a magnetic particle separator in which the magnetically attractable particles are captured on a non-magnetic hollow tube inserted in a particle stream of mixed materials. The non-magnetic tube attracts magnetic particles in the stream because of magnetic rods inserted in the interior of the hollow tubes while the tubes are in the particle stream. The magnetically attractable particles are removed from the surface of the tubes by withdrawing the magnetic rods from the interior of the tubes which removes the magnetic attraction force from the tube surface. The captured particles will fall from the tube surface when the magnetic force is removed. Such devices are referred to as grate magnets since there is usually a series of tubes lying side by side in the particle stream forming a grate-like structure.

The problem with such devices is that if the magnetic rods are removed from the non-magnetic tubes while the tubes are in the particle stream, the particles captured on the tubes will be released into the stream thereby contaminating the mixture in the stream. It is therefore desirable to provide a means of interlocking the magnetic rods in the tubes such that the magnetic rods cannot be removed from the tubes while the magnetic grate is in the particle stream.

A typical application for such a device is disclosed in U.S. Pat. No. 5,071,541 METHOD AND APPARATUS FOR SORTING A MIXTURE OF PARTICLES. In this patent, a non-magnetic plastic blasting material is used to remove old paint coatings from a structure instead of using chemical stripping compounds which may be hazardous to the employees health and to the environment. During the paint removing blasting operation, small magnetically attractable particles are removed from the surface of the structure and mix with the blasting medium as it falls from the structure. In recovering the plastic blasting medium for recycling in the system, it is necessary to remove from the blasting medium as much of the foreign material as possible to insure uniform results from the system. Non-magnetically attractable particles can be removed by physical separation methods and the magnetically attractable particles removed by a separator as described in this application.

SUMMARY OF THE INVENTION

This invention overcomes the problems of the magnetic separators of the prior art by providing an interlocked structure which will not allow the magnetizing rods of the grate to be removed while the separator is in the particle stream. The magnetic grate is assembled in a drawer frame which is open at the top and bottom so that when the drawer in inserted in the particle stream, the stream passes through the drawer structure and over the magnetic grate. The drawer is designed to be opened in a conventional manner to withdraw it from the particle stream. However, the magnetizing rods are inserted in the hollow tubes in a manner which prevents them from being removed until the drawer is removed from the stream. This is accomplished by making the rods inaccessible while the drawer is in place. That is, when the drawer is in the particle stream, the plate holding the rods is concealed in the drawer housing.

In addition, there is disclosed a system using two or more magnetic separators in series in the particle stream so that one separator may be removed from the stream for cleaning without shutting down the entire particle recovery system.

DETAILED DESCRIPTION OF THE INVENTION

Figure 1:
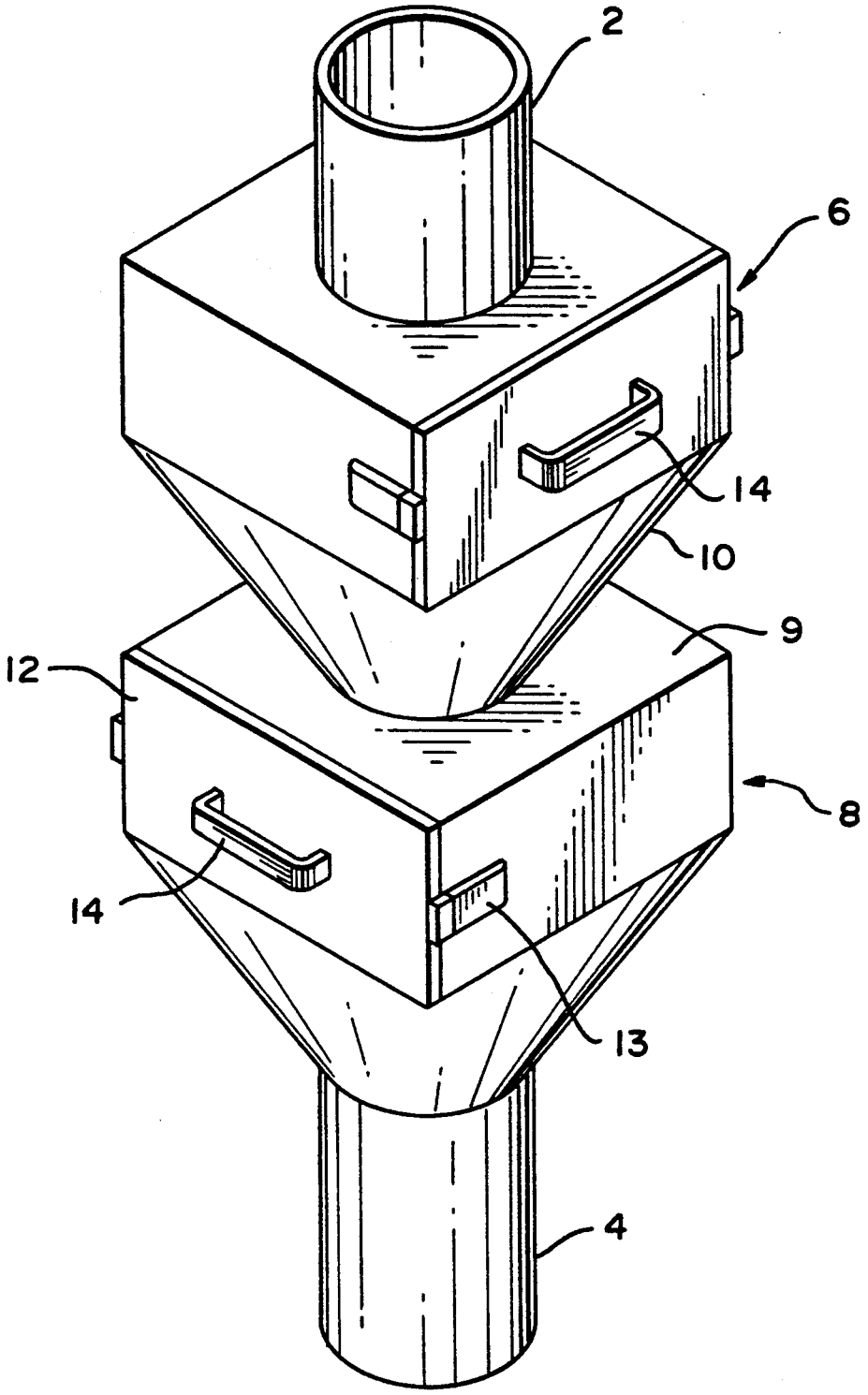
FIG. 1. is a perspective view of a dual separator embodiment of the invention.

Referring now to FIG. 1, there is shown a dual unit magnetic separator according to the invention. The assembly is connected in a particle stream in a conduit. The particle stream enters the separator at the entrance pipe 2 and is discharged through exit pipe 4 in lower separator. The separator units are shown at 6 and 8 assembled in series in the conduit. The separator units are preferably set in the particle conduit at an angle to each other in order to give them a distinctive appearance to assist the operator in scheduling cleaning of the individual separators. The units are substantially identical and only one will be described in detail.

Each separator is composed of a housing 9 having a drawer shown at 12. The drawer can be removed from the housing in a conventional manner by unlocking a latch 13 and pulling the drawer by means of handle 14.

Figure 2:
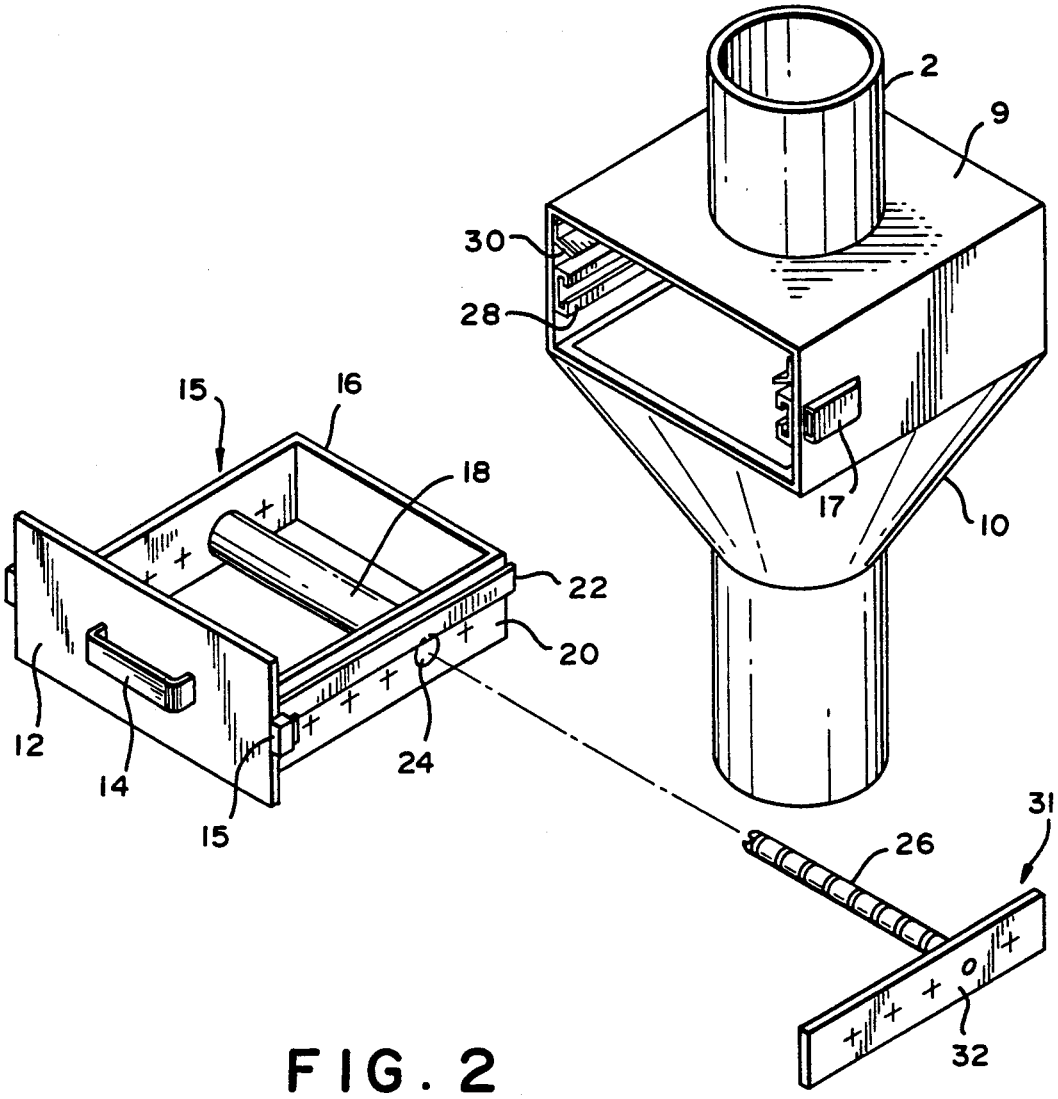
FIG. 2. is an exploded perspective view of one separator of the invention.

Referring now to FIG. 2, there is shown a perspective exploded view of one of the separator units 8. The drawer 15 is shown removed from the housing. The drawer consists of a back wall 16, identical side walls 20 and a drawer front 12. Attached to the drawer front is a handle 14 of any conventional design. Also attached to the drawer front is one portion 15 of the latch 13 shown in FIG. 1 and the other portion 17 attached to the housing 9. The drawer is constructed of stainless steel, aluminum or other non-magnetic material. Extending between the drawer side walls 20 are a series of hollow tubes 18 made of a non-magnetic material such as stainless steel, brass or other non-metallic materials such as plastic. The hollow tubes extend across the span of the drawer and are attached to the drawer side walls, for example, by welding. At least one end of the tube, shown at 24, is open through the side wall for insertion of the magnetic rod 26 which will be described in greater detail below. Attached to the external side of each side wall there is provided a one part of a drawer sliding mechanism 22 of any well known type. The matching part of the drawer slider is shown in the housing opening at 28. Inside the housing 9, there are provided particle deflectors 30 to direct the particle stream over the hollow tubes to insure that the magnetic particles in the stream come into contact with at least one of the tubes 18.

Adjacent the drawer 15 there is illustrated the magnetic rod assembly shown generally at 31. This assembly consists of a rod mounting plate 32 to which the magnetic rods 26 are attached. The rod assemblies are sized so that they fit within the inside diameter of the tubes 18. These rods are described in more detail in connection with the discussion of FIG. 4 below.

Figure 3:
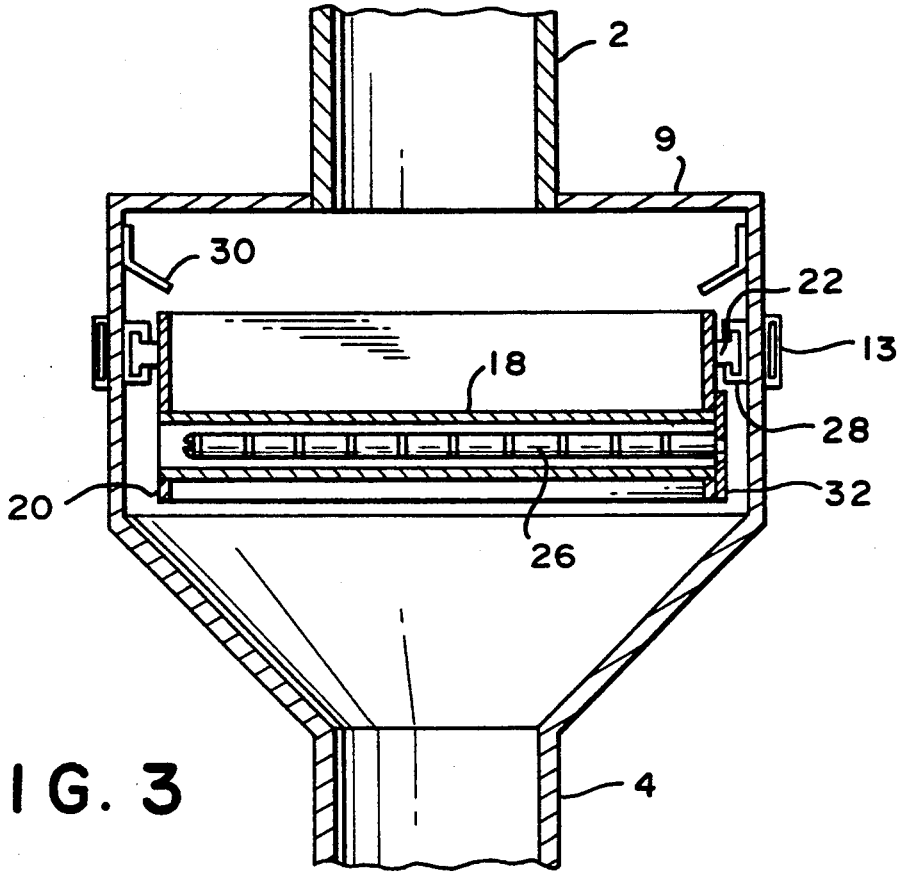
FIG. 3. is a sectional view taken through one of the separators.

Referring now to FIG. 3, there is shown a cross sectional view of the drawer assembly 15 installed in the housing 9. The drawer is shown mounted on its slider part 22 which is inserted in the other slider part 28 attached to the housing 9. The hollow tubes 18 are shown with the magnetic rods 26 inserted in the inside of the tubes. The particle stream enter the housing through the entrance pipe 2 and is directed to flow across the tubes 18 by deflectors 30. The particle stream then flows out of the housing through exit pipe 4.

Figure 4A:
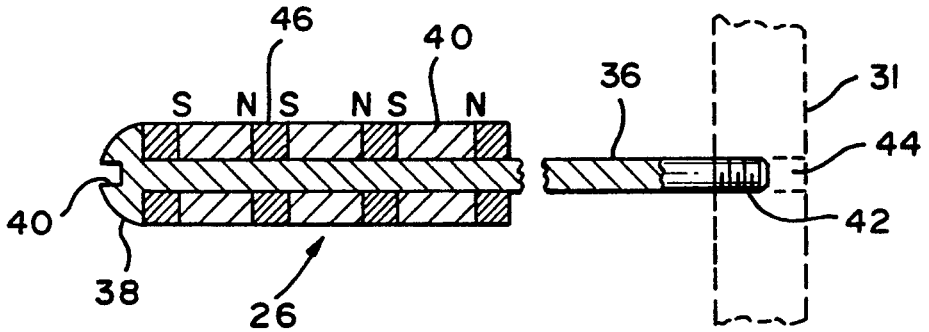
FIG. 4A. is a sectional view taken through one of the magnetic rods of the invention.
Figure 4B:
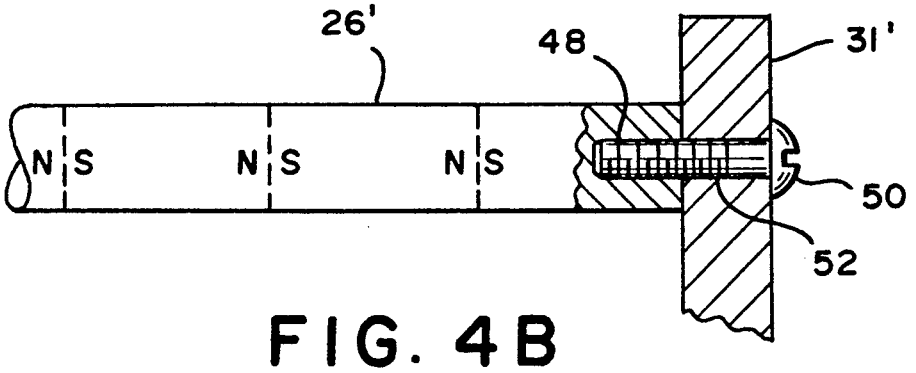
FIG. 4B is a partial sectional view of an alternate magnetic rod assembly.

Referring now to FIGS. 4A and 4B, there are shown two embodiments of the magnetic rod assemblies 26. In FIG. 4A, the rod assembly consists of a non-magnetic rod 36, made of brass or other non-magnetic material and of a length slightly shorter that the length of the tubes 18. The rod 36 has a screw head 38 at its inner end with a conventional screwdriver slot 40 therein. The other end of the rod 36 is threaded as shown at 42 and, in assembly, is threaded into a threaded hole 44 in the rod mounting plate 32. With this method of assembly, the rods may be replaced individually as required in case they are damaged or otherwise rendered unusable. The individual magnets 40 are assembled on the rod 36 separated by a non-magnetic spacer 46. The magnets illustrated are assembled so that the polarity of adjacent magnets are opposite in order to form a strong magnetic field at the surface of the tube 18 when the unit is assembled. If desired, the polarity sequence can be arranged with North-North/South-South polarity to obtain different magnetic field patterns. The magnetic rods are arranged so that the rods align with the tubes 18 in the drawer and the entire rod assembly can be removed as a single unit. In FIG. 4B, there is shown an alternate magnetic rod assembly, In this embodiment, the magnet 26′ is a unitary rod formed of a one piece rare-earth alloy magnet such as Kanetec KGM Series. The rod is provided with a threaded hole 48 in one end which receives a threaded bolt 50 extending through a hole 52 in the rod mounting plate 31′. This magnet is polarized in its structure to provide alternating poles along its length as shown in FIG. 4B.

This invention provides at least two important advantages over the prior art devices. First, by the use of dual magnetic separators in series in a particle stream, it is possible to remove the magnets of one separator for cleaning without shutting the system down. While one separator drawer is withdrawn for cleaning the other separator continues to function. In addition, the manner in which the drawer-magnet assembly is designed, it is impossible to remove the magnetic attractive force from the tubes while they are in the particle stream. This is accomplished by making the magnetic rod mounting plate assembly inaccessible when the drawer is installed in the particle stream. The mounting plate with its magnets attached, can only be removed from the assembly when the drawer is out of the particle stream.

Thus it can be seen that there is herein described a magnetic particle separator which insures continual operation of a particle stream magnetic separator and prevents accidental discharge of collected magnetically attractable particles into the particle stream.

What is claimed is:

1. A magnetic particle separator for removing magnetically attractable particles from a particle stream of mixed composition flowing in a conduit along an axis of flow, said separator comprising;

a housing forming an enlarged portion of said conduit, said housing being open at the top and bottom thereof to allow the particle stream to flow through said housing;

an entrance pipe formed at the top of said housing for receiving the particle stream into the housing;

an exit pipe formed at the bottom of said housing for exhausting the particle stream from the housing;

a first drawer assembly, having opposite side walls and front and back end walls forming a drawer open at its top and bottom and slideably mounted in said housing between said entrance pipe and said exit pipe for movement in one direction parallel to the plane of said side walls;

a plurality of hollow tubes extending between said side walls and attached at each end to one of said side walls of said drawer and transverse to the one direction of the drawer, said hollow tubes being open on at least one end;

a plurality of magnetic rods attached to a rod supporting plate to form a magnetic rod assembly, said magnetic rods being attached to said rod supporting plate to allow the rods to be inserted into the inside of said tubes through the open ends of said tubes and the rod supporting plate lying against the outside surface of one of said side walls of said drawer and between the outside of said side wall and the inside surface of said housing when the rods are in the tubes and said drawer is in said housing whereby the rods can only be removed from the tubes when the drawer is removed from the housing and;

a second drawer assembly the same as said first drawer assembly and assembled in said housing downstream from said first drawer assembly in said particle stream, said second drawer assembly mounted for movement in a second direction in a plane parallel to the plane of said one direction of movement of said first drawer assembly, said second direction being at an angle to said one direction of said first drawer assembly about the axis of flow of said particle stream.

2. The magnetic particle separator according to claim 1 wherein said second direction is at an angle to said one direction of approximately 90° about an the axis of flow of said particle stream.

3. The magnetic particle separator according to claim 1 and further comprising deflection plates attached near the top of each of the walls of said drawer and on the interior surface of said walls, said deflection plates extending from the walls of the drawer partially into the particle stream whereby most of the particle stream is caused to flow over the hollow tubes.

4. The magnetic particle separator according to claim 3 wherein said magnetic rods are comprised of;

a plurality of permanent magnets each having a north and a south pole, mounted on a magnet holder attached at one end to said rod supporting plate, said permanent magnets being arranged along said holder so that their north and south poles are oriented along the magnet holder in an alternating pattern; and a plurality of non-magnetic elements mounted on said magnet holder, one of said non-magnetic being placed between each of said adjacent permanent magnets.

5. The magnetic particle separator according to claim 4 wherein said permanent magnets and said non-magnetic elements are of substantially the same shape and of a size smaller than the inside diameter of said hollow tubes and are provided with a hole extending therethrough and said magnet holder comprises a bolt of non-magnetic material of smaller diameter than the holes in said magnets and said non-magnetic elements, said magnets and said non-magnetic elements being assembled on said bolt through said holes in alternating sequence, said bolt having a head on one end and a threaded portion on the other end, said threaded portion being screwed into a matching threaded hole in said rod supporting plate.

6. The magnetic particle separator according to claim 3 wherein said magnetic rods each comprise a unitary rod of a magnetic material, said rod being polarized along its length to form a plurality of alternating north and south poles along the length of the rod.

7. The magnetic particle separator according to claim 6 wherein said magnetic rods are provided with a threaded hole in one end thereof extending along a portion of the length of said rod, said rod supporting plate having a plurality of holes extending therethrough, and a bolt extending through each of said holes and threaded into the threaded hole in each of said rods for attaching said rods to said rod supporting plate.

* * * * *